US009887495B2

(12) United States Patent
Li et al.

(10) Patent No.: US 9,887,495 B2
(45) Date of Patent: Feb. 6, 2018

(54) POWER CONNECTOR

(71) Applicant: Tyco Electronics (Shanghai) Co. Ltd., Shanghai (CN)

(72) Inventors: Qianjin Li, Shanghai (CN); Guangming Zhao, Shanghai (CN); Yuqiang Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/360,506

(22) Filed: Nov. 23, 2016

(65) Prior Publication Data

US 2017/0149179 A1 May 25, 2017

(30) Foreign Application Priority Data

Nov. 23, 2015 (CN) ..... 2015 1 0819433

(51) Int. Cl.

| | |
|---|---|
| ***H01R 4/66*** | (2006.01) |
| ***H01R 13/6582*** | (2011.01) |
| ***H01R 12/72*** | (2011.01) |
| ***H01R 13/422*** | (2006.01) |
| ***H01R 13/627*** | (2006.01) |
| ***H01R 13/66*** | (2006.01) |
| ***H01R 12/70*** | (2011.01) |
| ***H01R 13/652*** | (2006.01) |

(52) U.S. Cl.

CPC ..... *H01R 13/6582* (2013.01); *H01R 12/7088* (2013.01); *H01R 12/724* (2013.01); *H01R 13/422* (2013.01); *H01R 13/6271* (2013.01); *H01R 13/652* (2013.01); *H01R 13/6683* (2013.01)

(58) Field of Classification Search

CPC ..... H01R 13/6582; H01R 12/724; H01R 13/422; H01R 13/6271; H01R 13/6683

USPC ..... 439/78, 108, 607.4, 947, 63

See application file for complete search history.

(56) References Cited

U.S. PATENT DOCUMENTS

| | | | | |
|---|---|---|---|---|
| 4,941,849 | A * | 7/1990 | Fujiura | H01R 13/6275 439/357 |
| 5,092,790 | A * | 3/1992 | Justiano | H05B 3/76 439/351 |
| 6,471,523 | B1 * | 10/2002 | Shuey | H01R 13/112 439/63 |
| 6,471,546 | B1 * | 10/2002 | Zhu | H01R 13/65802 439/607.4 |
| 7,645,165 | B2 * | 1/2010 | Wu | H01R 13/65802 439/607.38 |
| 7,901,249 | B1 * | 3/2011 | Chen | H01R 24/38 439/607.4 |
| 8,591,238 | B2 * | 11/2013 | Zhang | H01R 13/422 439/607.35 |
| 2014/0065889 | A1 * | 3/2014 | Zhang | H01R 43/24 439/660 |

* cited by examiner

*Primary Examiner* — Abdullah Riyami
*Assistant Examiner* — Nelson R Burgos-Guntin
(74) *Attorney, Agent, or Firm* — Barley Snyder

(57) ABSTRACT

A power connector is disclosed. The power connector has an insulation body, a ground terminal disposed on a side wall of the insulation body, and a power terminal disposed in the insulation body. The ground terminal has a resilient protrusion. A side surface of the power terminal has a recess facing the resilient protrusion, increasing a spacing between the resilient protrusion and the power terminal.

20 Claims, 3 Drawing Sheets

POWER CONNECTOR

CROSS-REFERENCE TO RELATED APPLICATION

This application claims the benefit of the filing date under 35 U.S.C. § 119(a)-(d) of Chinese Patent Application No. 201510819433.4, filed on Nov. 23, 2015.

FIELD OF THE INVENTION

The invention relates to a power connector, and more particularly, to a micro power connector.

BACKGROUND

Known micro power connectors generally only have a positive power terminal and a negative power terminal, and do not have a ground terminal. However, in some cases, it is necessary to provide the ground terminal to improve electrical security.

When known micro power connectors have the ground terminal, an electrical gap between contacts of the ground terminal and the power terminals is decreased due to the size restriction of the micro power connector, which may result in an unsafe creepage distance. In a power connector operating under a voltage of 60V, for example, the safe creepage distance between the terminals should be up to 1.2 mm to ensure electrical security. Furthermore, if the ground terminal is directly disposed in an insulation body with the positive and negative power terminals, a volume of the whole micro power connector will be increased, preventing the micro power connector from being arranged in a narrow space in a high density.

SUMMARY

An object of the invention, among others, is to provide a micro power connector having a ground terminal which neither reduces a creepage distance between the terminals nor increases the volume of the micro power connector. The disclosed power connector has an insulation body, a ground terminal disposed on a side wall of the insulation body, and a power terminal disposed in the insulation body. The ground terminal has a resilient protrusion. A side surface of the power terminal has a recess facing the resilient protrusion, increasing a spacing between the resilient protrusion and the power terminal.

BRIEF DESCRIPTION OF THE DRAWINGS

The invention will now be described by way of example with reference to the accompanying figures, of which.

DETAILED DESCRIPTION OF THE EMBODIMENTS

Figure 1:
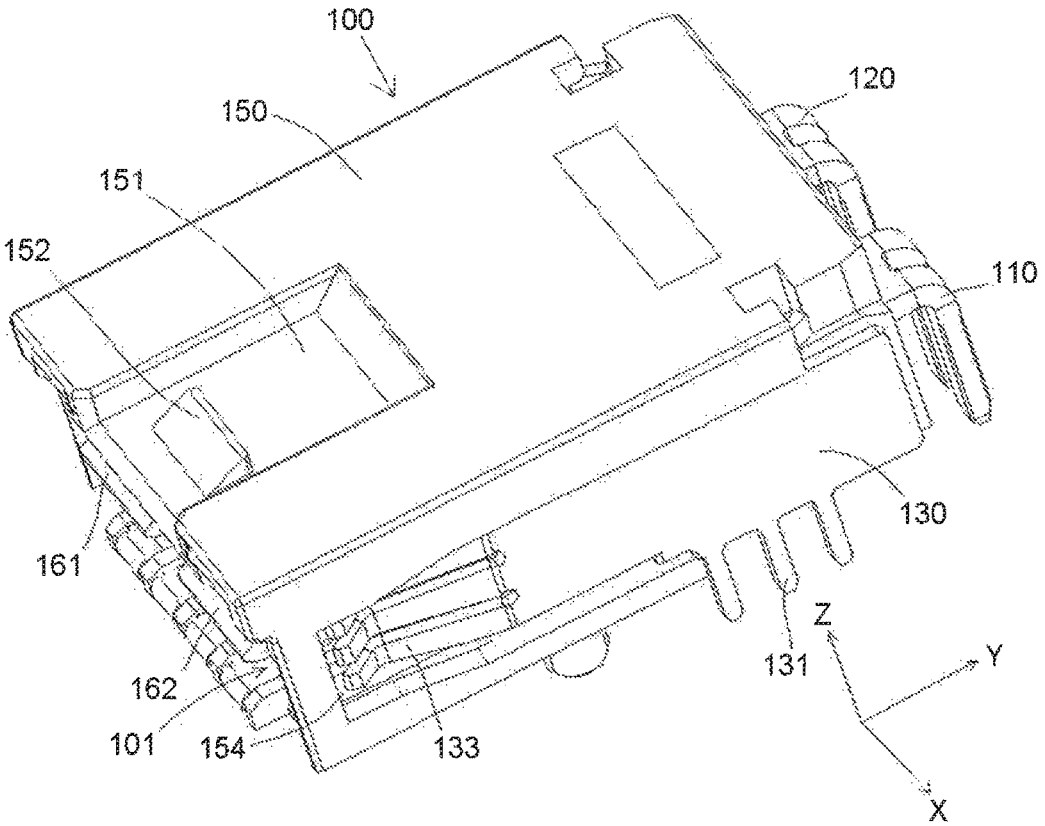
FIG. 1 is a perspective view of a power connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A power connector 100 according to the invention is shown in FIG. 1. The power connector 100 is a micro power connector adapted to be arranged in a narrow space in a high density. The power connector 100 has an insulation body 150, a pair of power terminals 110, 120, and a pair of ground terminals 130, 140.

Figure 2:
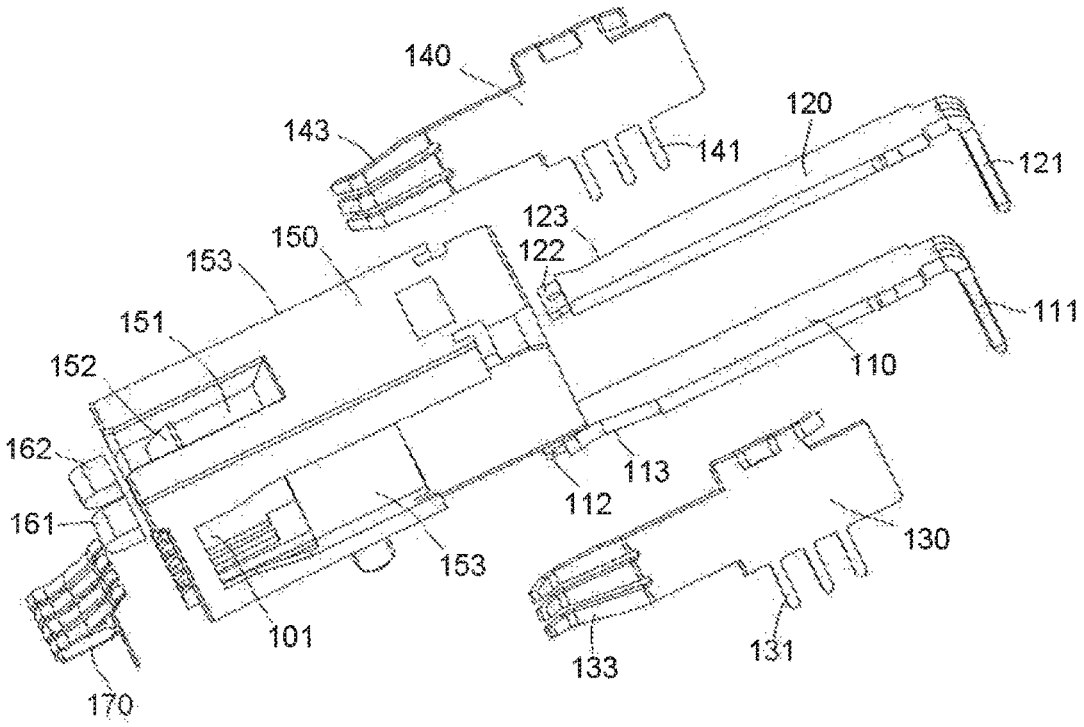
FIG. 2 is an exploded perspective view of the power connector of FIG. 1.
Figure 3:
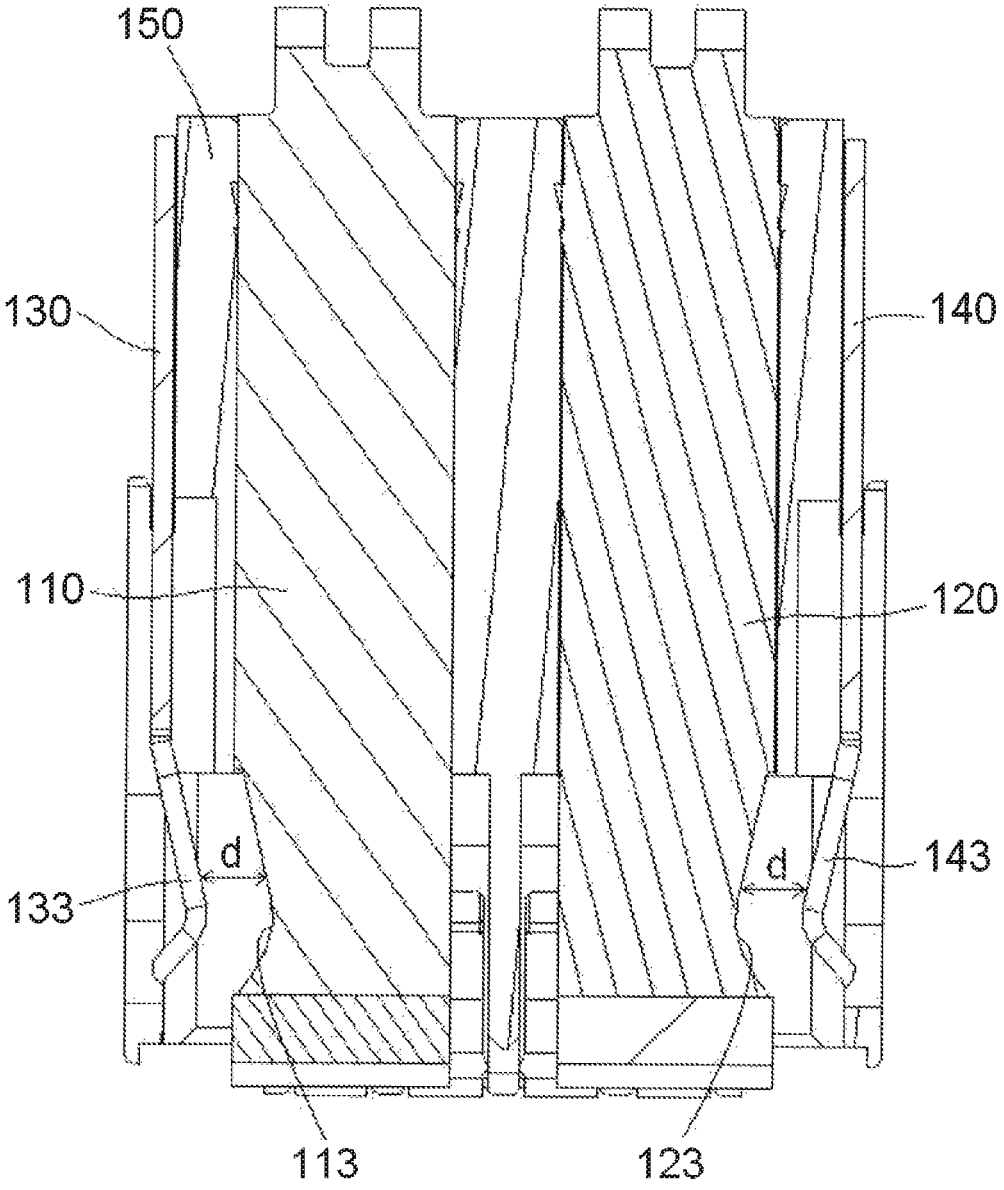
FIG. 3 is a sectional view of the power connector of FIG. 1.

The insulation body 150, as shown in FIGS. 1-3, has a bottom wall and a top wall located opposite to each other in a height direction Z thereof, a pair of side walls located opposite to each other in a width direction X thereof, and a front end and a rear end located opposite to each other in a length direction Y thereof.

The pair of ground terminals 130, 140 are held on the pair of side walls of the insulation body 150. The insulation body 150, as shown in FIGS. 1 and 2, has holing grooves 153 in the pair of side walls thereof, and the pair of ground terminals 130, 140 are held in the holing grooves 153 in the pair of side walls of the insulation body 150.

The ground terminals 130, 140, as shown in FIG. 2, each have resilient protrusions 133, 143. The resilient protrusions 133, 143, as shown in FIGS. 2 and 3, protrude toward side surfaces of the respective power terminals 110, 120. The resilient protrusions 133, 143 protrude into an insertion cavity 101 of the insulation body 150 formed at the front end through openings 154 formed in the side walls, respectively. The resilient protrusions 133, 143 electrically contact mating ground terminals of a mating electrical connector which have been inserted into the cavity 101.

The pair of power terminals 110, 120 are held in the insulation body 150. The power terminals 110, 120, as shown in FIGS. 1 and 2, have rigid contacts located in the cavity 101 of the insulation body 150. The power terminals 110, 120 are adapted to electrically contact mating power terminals of the mating electrical connector. In order to electrically contact the rigid contacts of the power terminals 110, 120, it would be necessary to provide the mating power terminals of the mating electrical connector with corresponding resilient electrical contacts.

The power terminals 110, 120, as shown in FIGS. 2 and 3, have recesses 113, 123 formed on side surfaces of the rigid contacts of the power terminals 110, 120. The recesses 113, 123 face the resilient protrusions 133, 143 on the side surfaces thereof so as to increase spacings d corresponding to a creepage distance between the resilient protrusions 133, 143 and the respective power terminals 110, 120. In this way, it is possible to ensure a sufficient creepage distance between the ground terminals 130, 140 and the power terminals 110, 120. Each of the spacings d between the resilient protrusions 133, 143 and the recesses 113, 123 is equal to or greater than a distance between other portions of the ground terminals 130, 140 and other portions of the respective power terminals 110, 120, as shown in FIG. 3. In an embodiment, each of the spacings d are equal to or greater than 1.2 mm. As shown in FIGS. 1 and 2, recess surface profiles of the recesses 113, 123 substantially match protrusion surface profiles of the resilient protrusions 133, 143. In an embodiment, both the recess surface profiles of the recesses 113, 123 and the protrusion surface profiles of the resilient protrusions 133, 143 are arc-shaped.

The power connector 100, as shown in FIGS. 1 and 2, further comprises a pair of insulation protection caps 161, 162 adapted to cover end portions 112, 122 of the rigid contacts of the pair of power terminals 110, 120 respectively. When the power connector 100 is not electrically connected with the mating electrical connector, the protection caps 161, 162 prevent a user from touching the end portions 112, 122 of the power terminals 110, 120, thereby effectively avoiding an electric shock accident from occurring and improving the use security of the power connector 100.

The power terminals 110, 120, as shown in FIGS. 1 and 2, have power terminal connecting pins 111, 121 extending from the rear end of the insulation body 150 and adapted to be electrically connected onto a circuit board. The ground terminals 130, 140 have ground terminal connecting pins 131, 141 extending from the bottom wall of the insulation body 150 and adapted to be electrically connected onto the circuit board. In an embodiment, the power terminal connecting pins 111, 121 and the ground terminal connecting pins 131, 141 are inserted into connection holes in the circuit board and welded onto the circuit board.

The insulation body 150, as shown in FIGS. 1 and 2, has a receiving groove 151 in the top wall thereof, and the receiving groove 151 is formed on a bottom wall thereof with a lock protrusion 152. The lock protrusion 152 engages an elastic lock arm of the mating electrical connector inserted into the receiving groove 151 to lock the power connector 100 and the mating electrical connector together.

The power connector 100, as shown in FIG. 2, may further comprise a signal detecting terminal 170 disposed in the insertion cavity 101 of the insulation body 150 and configured to detect a usage state of the power connector 100.

Advantageously, according to the power connector 100 of the present invention, since the power terminals 110, 120 are formed with the recesses 113, 123 in side surfaces thereof, the creepage distances between the ground terminals 130, 140 and the respective power terminals 110, 120 are increased. Furthermore, since the ground terminals 130, 140 are disposed in the side walls of the insulation body 150, the size of the power connector 100 will not be increased in width or height, and can still function as a micro power connector 100 arranged in a narrow space in a high density.

What is claimed is:

1. A power connector, comprising:

an insulation body;

a ground terminal disposed on a side wall of the insulation body, the ground terminal having a resilient protrusion; and a power terminal disposed in the insulation body, a side surface of a rigid contact of the power terminal having a recess facing the resilient protrusion and increasing a spacing between the resilient protrusion protruding toward the side surface of the power terminal and the power terminal.

2. The power connector of claim 1, wherein the resilient protrusion electrically contacts a mating electrical connector.

3. The power connector of claim 1, wherein the spacing between the resilient protrusion and the recess is equal to or greater than a distance between other portions of the ground terminal and other portions of the power terminal.

4. The power connector of claim 3, wherein the spacing is equal to or greater than 1.2 mm.

5. The power connector of claim 1, wherein the side wall has a holing groove.

6. The power connector of claim 5, wherein the ground terminal is held in the holing groove.

7. The power connector of claim 6, wherein the insulation body has an insertion cavity and an opening extending through the side wall into the insertion cavity.

8. The power connector of claim 7, wherein the resilient protrusion protrudes into the insertion cavity through the opening and electrically contacts a mating ground terminal of a mating electrical connector inserted into the cavity.

9. The power connector of claim 8, wherein the rigid contact is disposed in the insertion cavity and electrically contacts a mating power terminal of the mating electrical connector.

10. The power connector of claim 9, wherein a recess surface profile of the recess matches a protrusion surface profile of the resilient protrusion.

11. The power connector of claim 10, wherein the recess surface profile and the protrusion surface profile are arc-shaped.

12. The power connector of claim 9, further comprising an insulation protection cap covering an end portion of the rigid contact of the power terminal.

13. The power connector of claim 7, further comprising a signal detecting terminal disposed in the insertion cavity and detecting a use state of the power connector.

14. The power connector of claim 1, wherein the insulation body has a bottom wall and a top wall located opposite each other in a height direction thereof, a pair of side walls located opposite to each other in a width direction thereof, and a front end and a rear end located opposite to each other in a length direction thereof.

15. The power connector of claim 14, wherein a pair of power terminals are disposed in the insulation body and a pair of ground terminals are disposed on the pair of side walls.

16. The power connector of claim 14, wherein the power terminal has a power terminal connecting pin extending from the rear end of the insulation body and electrically connected to a circuit board.

17. The power connector of claim 16, wherein the ground terminal has a ground terminal connecting pin extending from the bottom wall of the insulation body and electrically connected to a circuit board.

18. The power connector of claim 14, wherein the insulation body has a receiving groove in the top wall, the receiving groove having a lock protrusion engaging an elastic lock arm of a mating electrical connector inserted into the receiving groove to lock the power connector and the mating electrical connector together.

19. The power connector of claim 8, wherein a portion of the side wall is disposed between the ground terminal and the power terminal.

20. The power connector of claim 10, wherein the recess surface profile and the protrusion surface profile are aligned in a direction perpendicular to an insertion direction of the mating electrical connector into the insertion cavity.

* * * * *